United States Patent [19]

Rhoads

[11] Patent Number: 4,546,876

[45] Date of Patent: Oct. 15, 1985

[54] BOTTLE CARRIER

[75] Inventor: Roger R. Rhoads, Toledo, Ohio

[73] Assignee: Owens-Illinois, Inc., Toledo, Ohio

[21] Appl. No.: 697,708

[22] Filed: Feb. 4, 1985

Related U.S. Application Data

[63] Continuation of Ser. No. 530,823, Sep. 9, 1983, abandoned.

[51] Int. Cl.[4] ..... B65D 71/02; B65D 85/62

[52] U.S. Cl. ..... 206/150; 206/151; 206/158; 294/87.2

[58] Field of Search ..... 206/150–159, 206/161, 427; 294/87.2, 87.28

[56] References Cited

U.S. PATENT DOCUMENTS

| | | | |
|---|---|---|---|
| 2,650,128 | 8/1953 | Failor | 294/87.2 |
| 3,084,792 | 4/1963 | Poupitch | 206/150 |
| 3,090,520 | 5/1963 | Wuerthner | 206/158 |
| 3,214,016 | 10/1965 | Stephan | 206/161 |
| 3,248,004 | 4/1966 | Weiss | 206/158 |
| 3,721,337 | 3/1973 | Braun et al. | 206/150 |
| 3,784,003 | 1/1974 | Bolton | 206/158 |
| 3,874,502 | 4/1975 | Wearer | 206/158 |
| 4,064,989 | 12/1977 | Olsen | 206/151 |
| 4,109,787 | 8/1978 | Klygis et al. | 206/150 |

*Primary Examiner*—William T. Dixson, Jr.
*Assistant Examiner*—Brenda J. Ehrhardt
*Attorney, Agent, or Firm*—Philip M. Rice

[57] ABSTRACT

A bottle carrier for carrying a plurality of bottles having a body portion and a neck portion and a closure applied to the neck portion forming an undercut at the area of juncture of the periphery of the closure and the neck comprising a generally flat blank formed of a material that is flexible and elastic and has a central portion with a plurality of openings and a peripheral band severable from the central portion and adapted to surround the bottles. Each opening is shaped so that only a portion of the periphery of the openings engages the area of juncture of the closure and bottle and a pair of tabs extend radially inwardly for engaging under the closure.

10 Claims, 5 Drawing Figures

BOTTLE CARRIER

This application is a continuation of application Ser. No. 530,823, filed 9/9/83 now abandoned.

This invention relates to bottle carriers and particularly bottle carriers for carrying a plurality of bottles having narrow necks with closures crimped over the necks.

BACKGROUND AND SUMMARY OF THE INVENTION

It has hereto been proposed that carriers for cans and bottles be made of a sheet of flexible and elastic material having a plurality of openings through which the upper ends of the cans or necks of the bottles extend and are held to provide a pack of cans or bottles.

In the making of such carriers for bottles having narrow necks such as conventionally used for soft drinks and beer, it is necessary that the bottles be secured in the carrier so that they can be readily handled and at the same time they can be easily removed without excessive force.

Various configurations of openings have heretofore been suggested as shown, for example, in U.S. Pat. No. 4,109,787.

Such a carrier has been extensively used in connection with cans. However, the use of such carriers for bottles having narrow necks such as conventionally used for soft drinks and beer has not been extensive because the bottles must be secured in the carrier so that they can be readily handled and at the same time can be easily removed without excess force.

When the carrier is applied to the necks of the containers, the periphery of the openings is deformed upwardly by the relative movement between the carrier and the neck of the bottle. When it is desired to remove the bottle, the deformed portion about the periphery of the opening must be first folded back down within the opening. The force necessary to do this may be excessive and is therefore undesirable.

The problem of securing the containers in the carrier and making the carrier such that the bottles can be readily removed is complicated by the nature of the closure applied to the bottles. Where the closure is a threaded plastic closure that is threaded on the neck of the bottle such that there is an undercut at the area of juncture of the periphery of the closure and the neck of the bottle, the problem is even more complex.

In the handling of bottles, a carrier that has been proposed is such as shown in U.S. Pat. No. 3,084,792 wherein the sheet of flexible elastic material comprises an inner part having the openings through which the upper ends of the necks extend and a peripheral band that is severed from the first part and moved about the periphery of the group of bottles to form an complete the package. Insofar as I am aware, such a carrier has not been satisfactory.

Among the objectives of the present invention are to provide a carrier which comprises a generally flat blank and has openings of a specific configuration such that bottles with threaded plastic closures will be securely held and yet be easily removed from the carrier.

In accordance with the invention, each opening is shaped such that the opening only partially engages the bottle finish and two small tabs project radially inwardly so that when the carrier is placed upon the containers, the small tabs are bent or flexed upwardly and into the undercut between the closure and the finish at the intersection of the closure and the finish. More specifically, each opening has a generally elliptical portion that extends preferably for about 200°, the tabs having one side tangential with the elliptical portion, and a portion of greater radial dimension which does not engage the container connecting the tabs and completing the opening. The tabs are asymmetrical with a short side and a long side, the long side of each tab forming part of the elliptical portion of the opening. Where the carrier has six openings, the openings in the corners are oriented so that the portions of the openings having the greater radial dimension extend toward the center of the carrier. Where six openings are provided, the openings at the center of the carrier comprises a portion for engaging the container which is in the form of a portion of an ellipse that extends for about 180°, a larger peripheral opening extending for about 180° with intervening tabs at the juncture of the portions and extending radially inwardly.

DESCRIPTION

Figure 1:
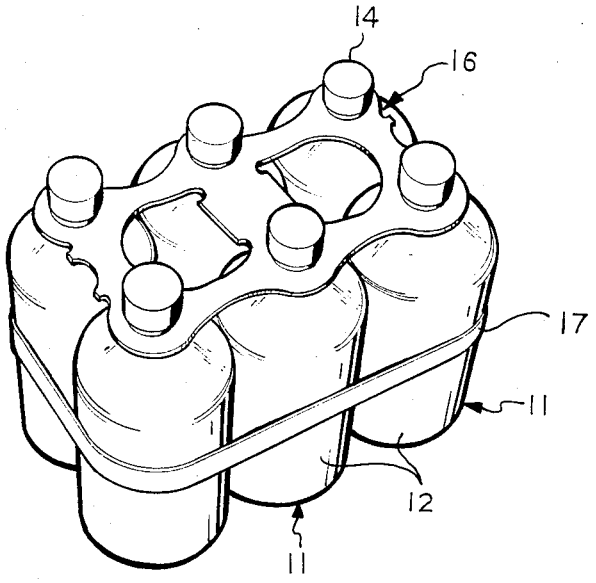
FIG. 1 is a perspective view of a carrier pack of a carrier embodying the invention on bottles with crimped closures.
Figure 4:
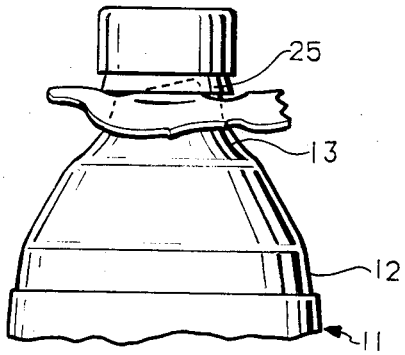
FIG. 4 is a fragmentary side elevational view of a portion of a carrier with a bottle in the carrier.

Referring to FIG. 1, the carrier 10 is shown as applied to the containers which comprise bottles 11 having a body portion 12 and a neck 13 with a threaded closure 14, the periphery of which forms an undercut 15 at the juncture of the closure 14 to the bottle 11 (FIG. 4).

Figure 2:
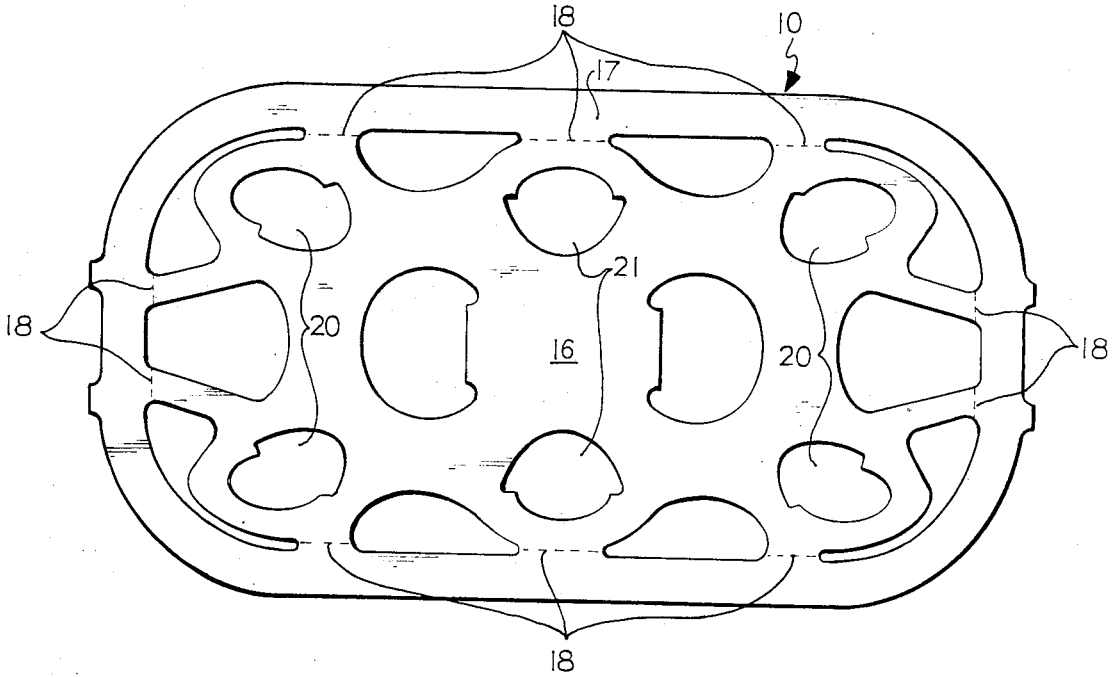
FIG. 2 is a plan view of the carrier.

Referring to FIG. 2, the carrier 10 comprises a flat blank of flexible and elastic material such as low density polyethylene and includes a central portion 16 and a band 17 connected to the central portion along broken or weakened lines 18 such that the band can be stretched and broken away from the central portion 16 during application of the carrier so that the band will surround the bodies of the bottles as shown in FIG. 1.

The carrier further includes a plurality of bottle receiving openings 20, 21 and finger receiving openings 22 for carrying the pack. Openings 20 are spaced from the center of the carrier and openings 21 lie on an axis intersecting the center of the carrier.

Figure 3:
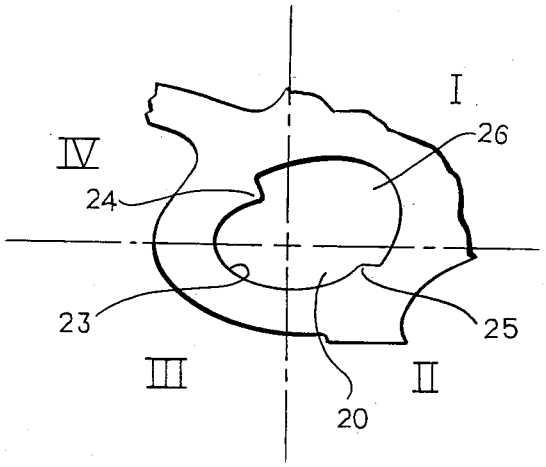
FIG. 3 is a fragmentary enlarged plan view of one of the bottle receiving openings of the carrier.

As shown in FIG. 3, each opening 20 is shaped such that a generally elliptical portion 23 of the opening 20 only partially surrounds and engages the bottle finish and two small tabs 24, 25 project radially inwardly so that when the carrier is placed upon the containers, the small tabs 24, 25 are bent or flexed upwardly and into the undercut between the closure and the finish at the intersection of the closure and the finish. More specifically, each opening has an elliptical portion 23 that extends preferably about 200°, the tabs 24, 24 having one side tangential with the elliptical portion, and a portion 26 of greater radial dimension which connects the tabs 24, 25 to complete the opening and which does not engage the container.

As shown, the tabs 24, 25 are asymmetrical with a short side and a long side, the long side of each tab 24, 25 forming part of the elliptical portion 23 of the opening 20. Referring to FIG. 3, it can be seen that the elliptical portion 23 of lesser radial dimension extends generally from a second quadrant II wherein the periphery is tangent to the tab 25 through a third quadrant III and to a fourth quadrant IV where the periphery of the elliptical portion 23 is tangent to the tab 24. On the other hand, the portion 26 of larger radius extends from tab 24 in the fourth quadrant IV through a first quadrant I and to the tab 25 in the second quadrant II.

Where the carrier has six openings, the openings 20 in the corners are oriented so that the portions 26 of the openings 20 having the greater radial dimension extend toward the center of the carrier where the fingers engage the carrier.

Figure 5:
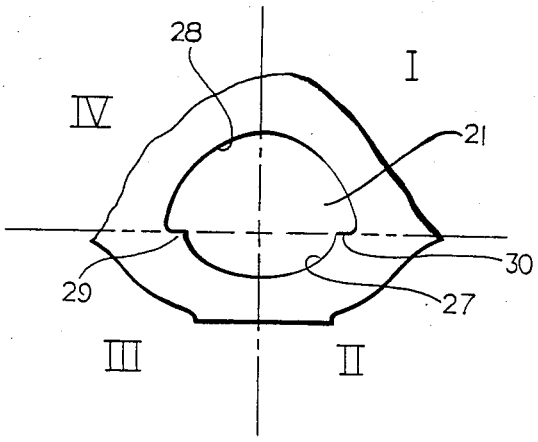
FIG. 5 is a fragmentary enlarged plan view of another of the openings of the carrier.

As shown in FIG. 5, where six openings or more are provided, the openings 21 at the center of the carrier comprise a generally elliptical portion 27 for engaging the container which is in the form of a part of an isometric ellipse that extends for about 180°, a larger peripheral portion 28 extending for about 180° toward the center of the carrier and the intervening tabs 29, 30 at the juncture of the openings and extending radially inwardly. The portion 27 of lesser dimension of each opening 21 extends throughout the second quadrant II and third quadrant III tangent to the tabs 29, 30 and the portion 28 of larger radial dimension extends throughout the fourth quadrant IV and first quadrant I.

In accordance with the invention, when the carrier is applied to the necks of the containers, the portions 23, 27 of the smaller elliptic configuration are stretched and deformed about the necks of the containers below the periphery of the skirt of the closure and tabs 24, 25 and 29, 30 flex upwardly under the undercut at the juncture of the closure and neck of the container (FIG. 4).

When the bottles which are in the endmost openings 20 in each row are to be removed, they are grasped and pulled downwardly and outwardly relative to the central portion of the carrier. The clearance provided by the portions 26 of greater diameter or radial dimension facilitates the removal of the bottles.

Similarly, with respect to the bottles that are in the central openings 21, the large clearance formed by the portions 28 permits ready removal.

Inasmuch as the portions 23, 27 of the opening which are flexed upwardly when the necks of the containers are inserted in the openings comprise spaced tabs, they are more readily folded back downwardly within the opening during the bottle removal process and do not contribute any excess force during the removal.

Tests on a carrier for six bottles with plastic closures wherein the carrier is made of low density polyethylene and a thickness of 22 mils have shown that the bottle package will withstand a drop test of one hundred 1½" drops and, at the same time, will not require excessive removal forces. As a result the bottles can be readily removed.

Thus, it has been found that the carrier will effectively retain bottles with plastic closures and yet permit the bottles to be readily removed.

I claim:

1. A bottle carrier for carrying a plurality of bottles having a body portion and a neck portion and a closure which forms an undercut at the juncture of the periphery of the closure and the neck of the bottle which comprises a generally flat blank formed of a material that is flexible and elastic, said blank having a central portion with a plurality of openings for receiving the neck of the containers and engaging the containers at the juncture of the closure fillet and the container and a peripheral band severable from the central portion and adapted to surround the bottles, each said opening having a generally elliptical portion extending for about 200° which is adapted to only partly surround and engage the bottle finish, tabs extending radially inwardly from the extremities of the elliptical portion, and a portion of greater radial dimension than said elliptical portion connecting said tabs to complete the opening, said elliptical portion being adapted to stretch and deform upwardly out of the plane of the carrier about the neck of said bottle, said tabs being adapted to flex upwardly out of the plane of said blank under the undercut between the closure and the finish at the intersection of the closure and the finish when the carrier is applied to the bottles and the portion of greater radial dimension being adapted to not engage said bottle, said portion of greater radial dimension extending toward the center of the central portion of the carrier.

2. The carrier set forth in claim 1 wherein said tabs are asymmetrical with a short and a long side, the long side of each said tab being tangential with and forming part of the elliptical portion of the opening.

3. The carrier set forth in claim 1 wherein said carrier comprises six openings, the openings in the corners being oriented such that the portions of the openings having a greater radial dimension extend toward the center of the carrier, the openings at the center of each row having a configuration comprising an elliptical portion that extends for about 180° and a larger peripheral portion extending for about 180° toward the center of the carrier and the intervening tabs at the juncture of the portions of the openings and extending radially inwardly.

4. A bottle carrier for carrying a plurality of bottles having a body portion and a neck portion and a closure which forms an undercut at the juncture of the periphery of the closure and the neck of the bottle which comprises a generally flat blank formed of a material that is flexible and elastic, said blank having a central portion with a plurality of openings for receiving the neck of the containers and engaging the containers at the juncture of the closure fillet and the container, each said opening having a generally elliptical portion extending for about 200° such that when the bottles are to be removed, each is grasped and pulled downwardly and outwardly relative to the carrier and the elliptical portions and tabs which were flexed upwardly are readily folded back downwardly within the opening and the portions of greater radial dimension provide a clearance to facilitate removal of the bottle, tabs extending radially inwardly from the extremities of the elliptical portion, and a portion of greater radial dimension than said elliptical portion connecting said tabs to complete the opening, said elliptical portion being adapted to stretch and deform upwardly out of the plane of the carrier about the neck of said bottle, said tabs being adapted to flex upwardly out of the plane of said blank under the undercut between the closure and the finish at the inersection of the closure and finish when the carrier is applied to the bottles and the portion of greater radial dimension being adapted to not engage said bottle, said portion of greater radial dimension extending toward the center of the central portion of the carrier.

5. The carrier set forth in claim 4 wherein said tabs are asymmetrical with a short and a long side, the long side of each said tab being tangential with and forming part of the elliptical portion of the opening.

6. The carrier set forth in claim 4 wherein said carrier comprises six openings, the openings in the corners being oriented such that the portions of the openings having a greater radial dimension extend toward the center of the carrier, the openings at the center of each row having a configuration comprising an elliptical portion that extends for about 180° and a larger peripheral portion extending for about 180° toward the center of the carrier and the intervening tabs at the juncture of the portions of the openings and extending radially inwardly.

7. A bottle package comprising a plurality of bottles having a body portion and a neck portion and a closure which form an undercut at the juncture of the periphery of the closure and the neck of the bottle which comprises a generally flat blank formed of a material that is flexible and elastic, said blank having a central portion with a plurality of openings receiving the neck of the containers and engaging the containers at the juncture of the closure fillet and the container, each said opening having a generally elliptical portion extending for about 200°, tabs extending radially inwardly from the extremities of the elliptical portion, and a portion of greater radial dimension connecting said tabs completing the opening, said elliptical portion stretching and deforming about the neck of said bottle and said tabs flexing upwardly out of the plane of said blank under the undercut between the closure and the finish at the intersection of the closure and finish and the portion of greater radial dimension does not engage the bottle, said portion of greater radial dimension extending toward the center of the central portion of the carrier.

8. The bottle package set forth in claim 7 wherein said tabs are asymmetrical with a short and a long side, the long side of each said tab being tangential with and forming part of the elliptical portion of the opening.

9. The bottle package set forth in claim 7 wherein said carrier comprises six openings, the openings in the corners being oriented such that the portions of the openings having a greater radial dimension extend toward the center of the carrier, the openings at the center of each row having a configuration comprising an elliptical portion that extends for about 180° and a larger peripheral portion extending for about 180° toward the center of the carrier and the intervening tabs at the juncutre of the portions of the openings and extending radially inwardly.

10. The bottle package set forth in claim 7 including a peripheral band severable from the central portion and adapted to surround the bottles.

* * * * *